US007232341B2

(12) United States Patent
Shinmyo

(10) Patent No.: US 7,232,341 B2
(45) Date of Patent: Jun. 19, 2007

(54) CONNECTOR IN WHICH A SHELL CAN BE READILY ASSEMBLED TO A CONNECTOR HOUSING

(75) Inventor: Minoru Shinmyo, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 11/283,134

(22) Filed: Nov. 19, 2005

(65) Prior Publication Data

US 2006/0110982 A1 May 25, 2006

(30) Foreign Application Priority Data

Nov. 19, 2004 (JP) ..... 2004-336166

(51) Int. Cl.
*H01R 9/03* (2006.01)

(52) U.S. Cl. ..... 439/610; 439/607

(58) Field of Classification Search ..... 439/610, 439/607, 585

See application file for complete search history.

(56) References Cited

U.S. PATENT DOCUMENTS 5,044,977 A * 9/1991 Vindigni ..... 439/374
5,597,322 A * 1/1997 Inaba et al. ..... 439/578
6,183,303 B1 * 2/2001 Sato ..... 439/610
6,390,852 B1 * 5/2002 Wang ..... 439/610
6,533,609 B2 * 3/2003 Koide ..... 439/578
6,554,644 B2 * 4/2003 Koide ..... 439/585
6,709,290 B2 * 3/2004 Yoshida ..... 439/585
6,814,615 B2 * 11/2004 Laub et al. ..... 439/585
6,929,512 B2 * 8/2005 Lai ..... 439/610
2003/0049966 A1 * 3/2003 Yoshioka ..... 439/610

FOREIGN PATENT DOCUMENTS

JP 2002-319456 A 10/2002
JP 2002-334764 A 11/2002

* cited by examiner

*Primary Examiner*—Tulsidas C. Patel
*Assistant Examiner*—Vladimir Imas
(74) *Attorney, Agent, or Firm*—Frishauf, Holtz, Goodman & Chick, P.C.

(57) ABSTRACT

In a connector including a conductive contact to be connected to a cable and a housing holding the contact, a conductive shell is coupled to the housing. The housing has a first surface with an engaging portion. The conductive shell includes a main body adapted to cover three surfaces of the housing except for the first surface and a cable holding portion formed integral with the main body for fixing the cable. The main body has a protrusion engaged with the engaging portion.

9 Claims, 7 Drawing Sheets

CONNECTOR IN WHICH A SHELL CAN BE READILY ASSEMBLED TO A CONNECTOR HOUSING

This application claims priority to prior Japanese application JP 2004-336166, the disclosure of which is incorporated herein by reference.

BACKGROUND OF THE INVENTION

The present invention relates to a connector having a shell covering and holding a housing.

For example, a connector of the type is disclosed in Japanese Unexamined Patent Application Publication (JP-A) No. 2002-319456. The connector comprises an assembly composed of three members, i.e., an inner conductor terminal, a dielectric housing, and a relay terminal. The assembly is inserted into a conductor shell and connected to a cable. The above-mentioned connector requires a large number of components and a large number of steps. In addition, the connector has a large number of connecting parts formed by assembling. This results in a decrease in mechanical strength.

Another connector of the type is disclosed in Japanese Unexamined Patent Application Publication (JP-A) No. 2002-334764. In the connector, an inner conductor terminal is locked in a dielectric housing. The dielectric housing is covered with an outer conductor shell fitted around the dielectric housing. The inner conductor terminal has a cable connecting portion connected to a cable. The outer conductor shell has a tubular portion accommodating the dielectric housing and a crimping barrel coupled to one axial end of the tubular portion. The crimping barrel crimps and holds the cable. The above-mentioned connector is assembled by locking the inner conductor terminal in the dielectric housing, fitting the outer conductor shell around the dielectric housing, and connecting the cable to the cable connecting portion of the inner conductor terminal. Therefore, the number of steps for harness work known in the art is increased.

SUMMARY OF THE INVENTION

It is therefore an object of this invention to provide a connector which can be reduced in number of components and in number of assembling steps.

It is another object of this invention to provide a connector which can be reduced in number of steps for harness work.

It is still another object of this invention to provide a connector having an easily stackable structure.

Other objects of the present invention will become clear as the description proceeds.

According to an aspect of the present invention, there is provided a connector which comprises a conductive contact to be connected to a cable, a housing holding the contact and having a first surface with an engaging portion, and a conductive shell coupled to the housing, the conductive shell comprising a main body adapted to cover three surfaces of the housing except for the first surface and a cable holding portion formed integral with the main body for fixing the cable, the main body having a protrusion engaged with the engaging portion.

DESCRIPTION OF THE PREFERRED EMBODIMENT

Referring to FIGS. 1 to 4, a connector according to a first embodiment of this invention will be described.

The connector depicted at 11 in the figures is movable in a separating direction A parallel to a first axis X and a coupling direction B opposite to the separating direction A so as to be coupled to and separated from a mating connector 51. Herein, the connector 11 is a plug connector and the mating connector 51 is a receptacle connector to be fixed to an apparatus. In case where the mating connector 51 is not fixed to the apparatus, the connector 11 and the mating connector 51 may be moved relative to each other to be coupled and separated.

Figure 2:
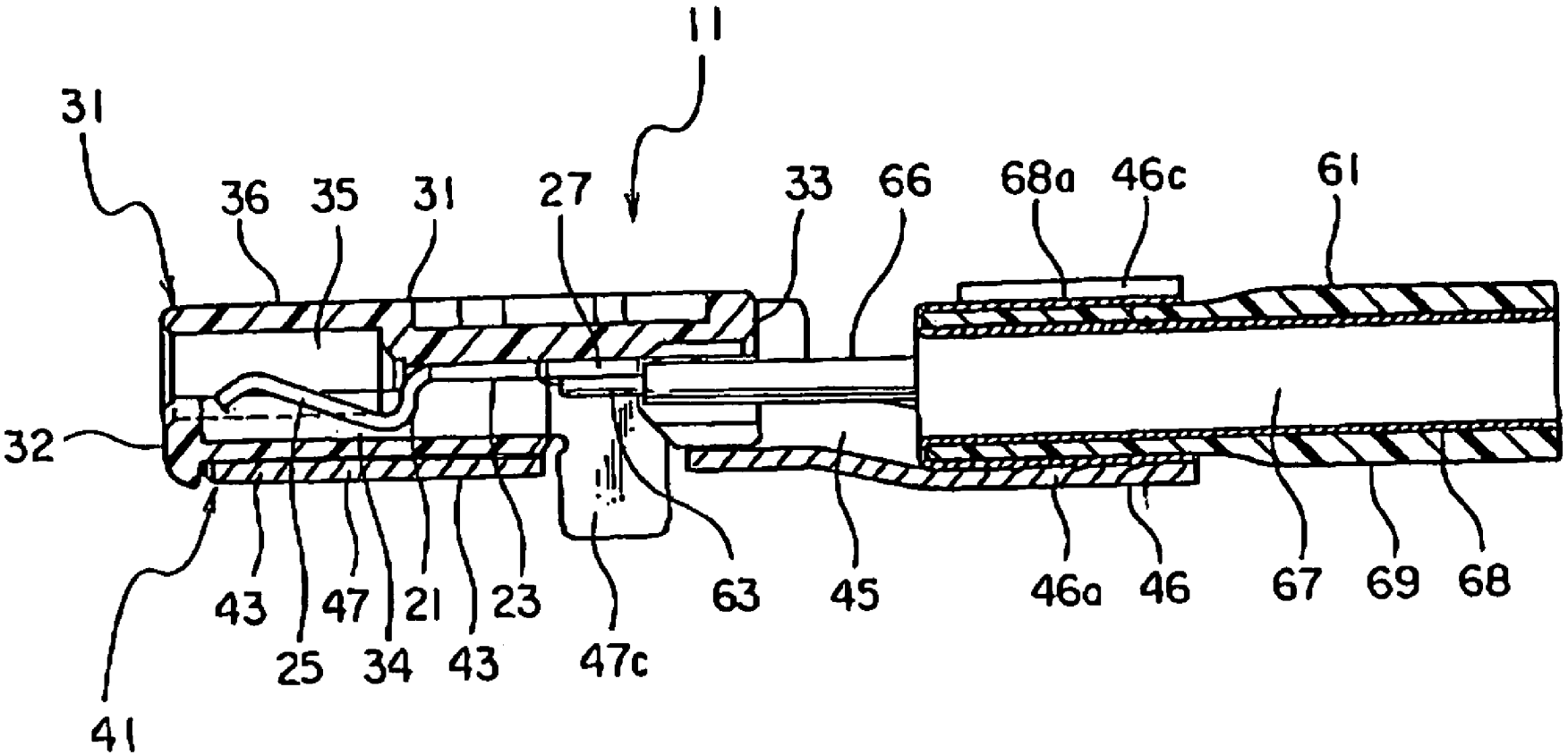
FIG. 2 is a sectional view of the connector in FIG. 1 when a cable is connected thereto.
Figure 3:
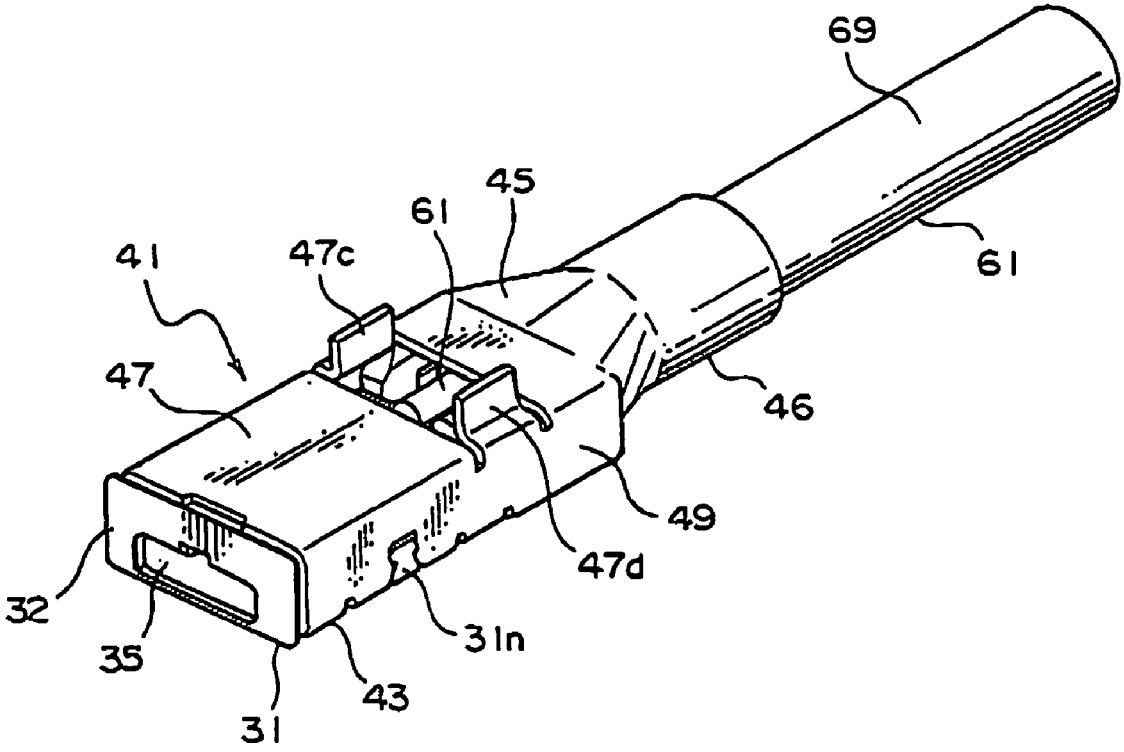
FIG. 3 is a perspective view of the connector in FIG. 1 as seen from a bottom side.

The connector 11 comprises at least one conductive contact (more particularly, a pair of conductive contacts) 21, an insulating housing 31 holding the contact 21, and a conductive shell 41 held on an outer peripheral surface of the housing 31. As best shown in FIG. 2, the contact 21 has a holding portion 23, a contacting portion 25 extending from one end of the holding portion 23 in the coupling direction B, and a connecting portion 27 extending from the other end of the holding portion 23 in the separating direction A.

The housing 31 has a coupling surface 32 as a forward surface in the coupling direction B, a rear surface 33 as a forward surface in the separating direction A, and a receiving portion 34 forming a space between the coupling surface 32 and the rear surface 33 in the housing 31 to receive the contact 21. The coupling surface 32 is faced to the mating connector 51 in the coupling direction B and the separating direction A when the connector 11 and the mating connector 51 are coupled to and separated from each other. In the housing 31, a coupling portion 35 extending from the coupling surface 32 in the separating direction A is formed. The coupling portion 35 serves to receive a mating coupling portion 52 of the mating connector 51 to bring a mating contact 53 into contact with the contacting portion 25 of the contact 21. The rear surface 33 of the housing 31 is provided with an inlet hole 34*a* for introducing a cable 61 into the receiving portion 34 of the housing 31.

The outer peripheral surface of the housing 31 except the coupling surface 32 and the rear surface 33 has a first surface 36 parallel to a virtual plane containing the first axis X and a second axis Y perpendicular to the first axis X, a second surface 37 faced to the first surface 36 in parallel thereto, and third and fourth surfaces 38 and 39 parallel to the first axis X, perpendicular to the second axis Y, and connecting one sides and the other sides of the first and the second surfaces 36 and 37. At a portion where the first surface 36 and the third surface 38 intersect each other, a first engaging portion 31*a* is formed in the vicinity of the coupling surface 32 across the first surface 36 and the third surface 38. At a portion where the first surface 36 and the fourth surface 39 intersect each other, a second engaging portion 31*b* is formed in the vicinity of the coupling surface 32 across the first surface 36 and the fourth surface 39.

The first and the second engaging portions 31*a* and 31*b* are faced to each other on the first surface 36 in a direction parallel to the second axis Y. The first engaging portion 31*a* has a recessed shape slightly depressed from the first and the third surfaces 36 and 38. The second engaging portion 31*b* has a recessed shape slightly depressed from the first and the fourth surfaces 36 and 39.

Further, at the portion where the first and the third surfaces 36 and 38 intersect each other, a third engaging portion 31*c* is formed in the vicinity of the rear surface 33 across the first and the third surfaces 36 and 38. At the portion where the first and the fourth surfaces 36 and 39 intersect each other, a fourth engaging portion 31*d* is formed in the vicinity of the rear surface 33 across the first and the fourth surfaces 36 and 39.

The third and the fourth engaging portions 31*c* and 31*d* are faced to each other on the first surface 36 in the direction parallel to the second axis Y. The third engaging portion 31*c* has a recessed shape slightly depressed from the first and the third surfaces 36 and 38. The fourth engaging portion 31*d* has a recessed shape slightly depressed from the first and the fourth surfaces 36 and 39. The first surface 36 is provided with groove-like locked portions 31*f* and 31*g* formed in the vicinity of the third and the fourth engaging portions 31*c* and 31*d*, respectively.

The housing 31 is provided with a first protrusion 31*m* formed between the first and the third engaging portions 31*a* and 31*c* and extending along the third surface 38 from the first surface 36 towards the second surface 37, and a second protrusion 31*n* formed between the second and the fourth engaging portions 31*b* and 31*d* and extending along the fourth surface 39 from the first surface 36 towards the second surface 37. The first protrusion 31*m* protrudes outward from the third surface 38. The second protrusion 31*n* protrudes outward from the fourth surface 39.

Figure 1:
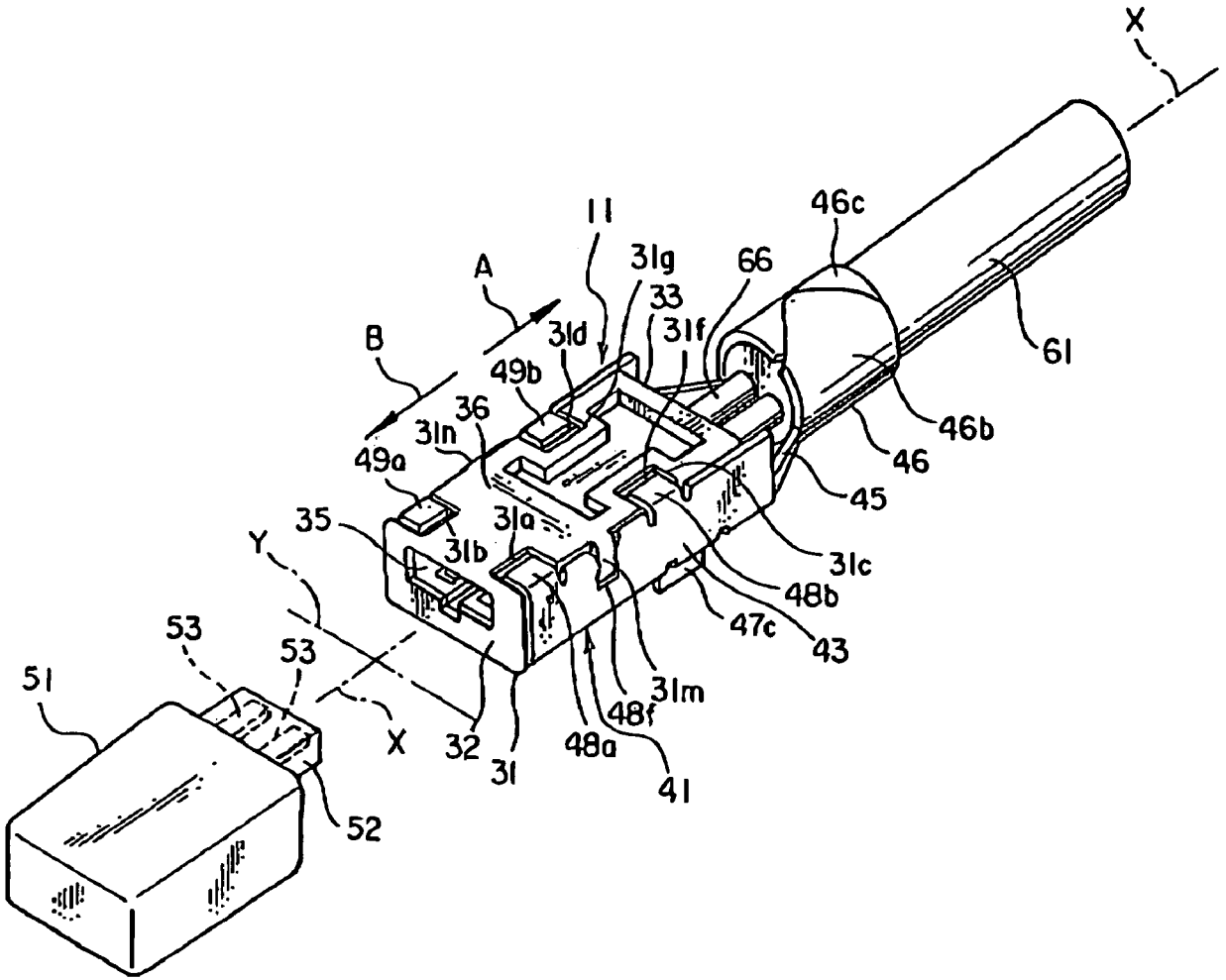
FIG. 1 is a perspective view of a connector according to a first embodiment of this invention.

In case where the first through the fourth surfaces 36 to 39 of the housing 31 are seen in the state illustrated in FIG. 1, the first surface 36 is an upper surface of the housing 31. The second surface 37 is a lower surface of the housing 31. The third and the fourth surfaces 38 and 39 are a pair of side surfaces of the housing 31. The housing 31 having the first through the fourth surfaces 36 to 39, the coupling surface 32, and the rear surface 33 has an external appearance as a generally rectangular parallelepiped.

The shell 41 has a main body 43, a pair of connecting portions 45, and a cable holding portion 46 extending from one end of the main body 43 in the separating direction A via the connecting portions 45 in the separating direction A. The main body 43 has a flat base plate portion 47 parallel to the virtual plane containing the first axis X and the second axis Y, a first holding plate portion 48 perpendicularly bent from one side of the base plate portion 47 which is parallel to the first axis X, and a second holding plate portion 49 perpendicularly bent from the other side of the base plate portion 47 which is parallel to the first axis X.

The base plate portion 47 is faced to the second surface 37 of the housing 31. The first and the second holding plate portions 48 and 49 are faced to the third and the fourth surfaces 38 and 39 of the housing 31 in one-to-one correspondence.

The first holding plate portion 48 is provided with a first shell protrusion 48*a* to be engaged with the first engaging portion 31a of the housing 31. The second holding plate portion 49 is provided with a second shell protrusion 49*a* to be engaged with the second engaging portion 31*b* of the housing 31. The first holding plate portion 48 is provided with a third shell protrusion 48*b* to be engaged with the third engaging portion 31*c* of the housing 31. The second holding plate portion 49 is provided with a fourth shell protrusion 49*b* to be engaged with the fourth engaging portion 31*d* of the housing 31.

Further, the first holding plate portion 48 is provided with an engaged portion 48*f* as a cutout to be engaged with the first protrusion 31*m* of the housing 31. The second holding plate portion 49 is provided with an engaged portion 49*f* as a cutout to be engaged with the second protrusion 31*n* of the housing 31.

The base plate portion 47 is provided with a pair of locking tab portions (locking portions) 47*c* and 47*d* each of which is formed by cutting and bending a part of the base plate portion 47. The locking tab portions 47*c* and 47*d* are bent from the base plate portion 47 outward of the main body 43 to be substantially perpendicular to the base plate portion 47. In a sectional view taken along the direction parallel to the second axis Y in FIG. 4, the main body 43 has a generally square-U shape opened at an upper end.

The cable holding portion 46 has a bottom portion 46*a* connected to ends of the connecting portions 45 and a pair of holding tab portions 46*b* and 46*c* extending from the bottom portion 46*a* to face each other. The cable holding portion 46 has a generally U shape in a sectional view taken along the direction parallel to the second axis Y.

The cable 61 comprises two inner conductors 63, insulating first cladding portions 66 covering the inner conductors 63, respectively, an insulating second cladding portion 67 integrally covering the first cladding portions 66 containing the inner conductors 63, a conductive outer conductor 68 formed on an outer peripheral surface of the second cladding portion 67, and an outer cladding portion 69 covering the outer conductor 68.

The at least one contact 21 is received and held in the receiving portion 33 formed in the housing 31. The connecting portion 27 of the contact 21 is connected to the inner conductor 63 of the cable 61 introduced into the housing 31. The outer conductor 68 has an end portion 68*a* folded back along an outer peripheral end portion of the outer cladding portion 69 and connected to the cable holding portion 46.

Inside the bottom portion 46*a* and the holding tab portions 46*b* and 46*c* of the cable holding portion 46, an end portion of the cable 61 is placed. The holding tab portions 46*b* and 46*c* are rounded and brought into press contact with the cable 61 to hold the cable 61. At this time, the holding tab portions 46*b* and 46*c* are brought into contact with the end portion 68*a* of the outer conductor 68. So that, the shell 41 is electrically connected to the outer conductor 68 to electromagnetically shield the contact 21 and other conductive portions surrounded by or covered with the shell 41.

The housing 31 is formed by molding a dielectric material. The shell 41 may be formed by punching a conductive plate into a predetermined flat pattern using a press and bending the predetermined flat pattern.

Figure 4:
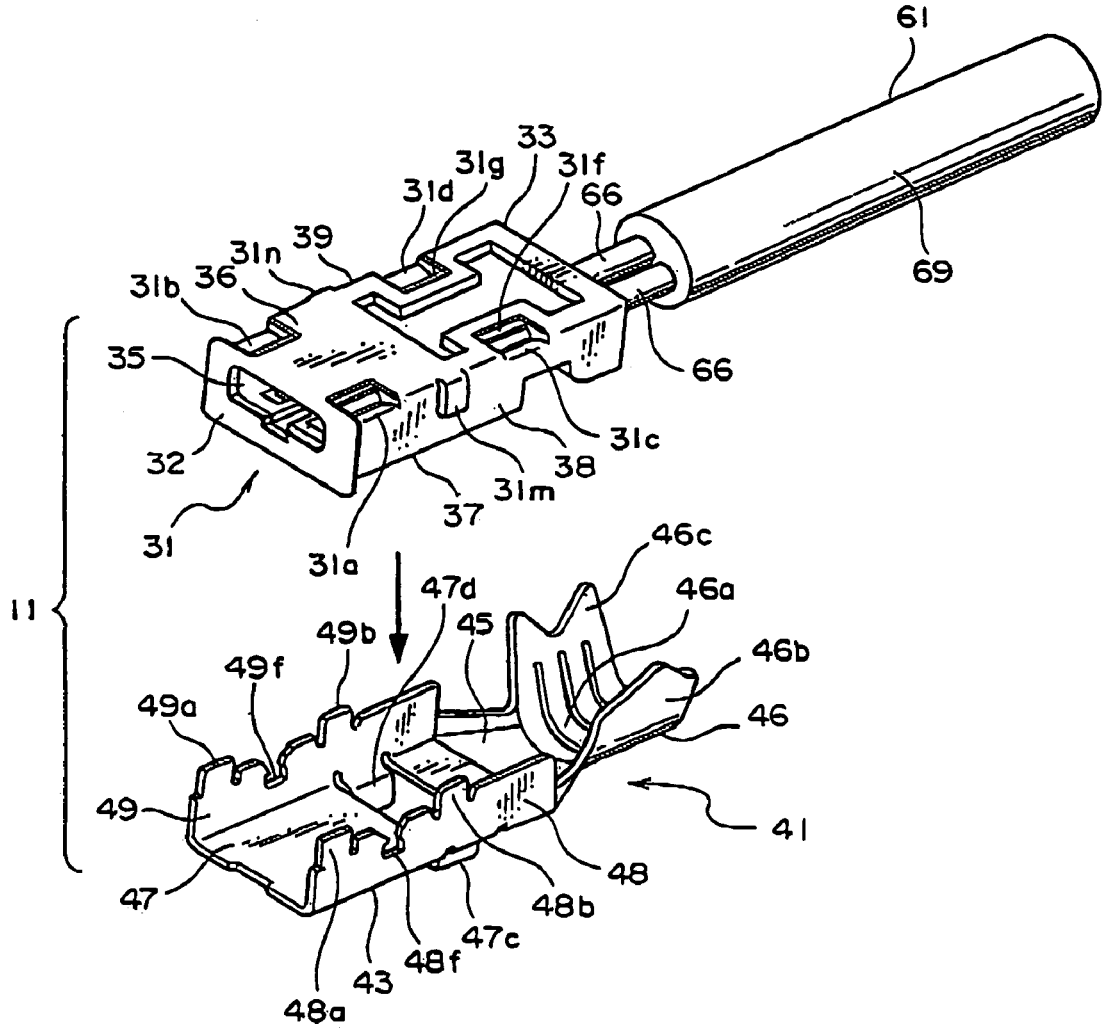
FIG. 4 is an exploded perspective view of the connector in FIG. 1.

The shell 41 is coupled to the housing 31 in the following manner. The connecting portion 27 of the contact 21 is connected to the inner conductor 63 of the cable 61. The holding tab portions 46*b* and 47*c* are perpendicularly bent with respect to the base plate portion 47. In this state, the housing 31 having the contact 21 is placed on the base plate portion 47 as shown in FIGS. 2 and 4. Then, the first through the fourth shell protrusions 48*a*, 48*b*, 49*a*, and 49*b* are bent and engaged with the first through the fourth engaging portions 31*a*, 31*b*, 31*c*, and 31*d* in one-to-one correspondence. At this time, the first and the second protrusions 31*m* and 31*n* of the housing 31 are fitted into the engaged portions 48*f* and 49*f* as the cutouts. The holding tab portions 46*b* and 46*c* are bent towards the end portion 68*a* of the outer conductor 68 of the cable 61 to be brought into press contact therewith.

The operation of bending the first through the fourth shell protrusions 48*a*, 48*b*, 49*a*, and 49*b* in order to fix the housing 31 to the main body 43 of the shell 41 and a harness work for connecting the cable 61 can be carried out simultaneously. The operation of connecting the contact 21 and the inner conductor 63 of the cable 61 may be carried out via an opening formed between the locking tab portions 47*c* and 47*d* of the base plate portion 47 after the bending operation of the first through the fourth shell protrusions 48*a*, 48*b*, 49*a*, and 49*b* and the harness work for connecting the cable 61.

In case where a plurality of connectors 11 are stacked and integrally used, the locking tab portions 47*c* and 47*d* of the shell 41 of one connector 11 are fitted to the locked portions 31*f* and 31*g* of another connector 11. Then, the locking tab portions 47*c* and 47*d* are engaged with the locked portions 31*f* and 31*g*.

Figure 5:
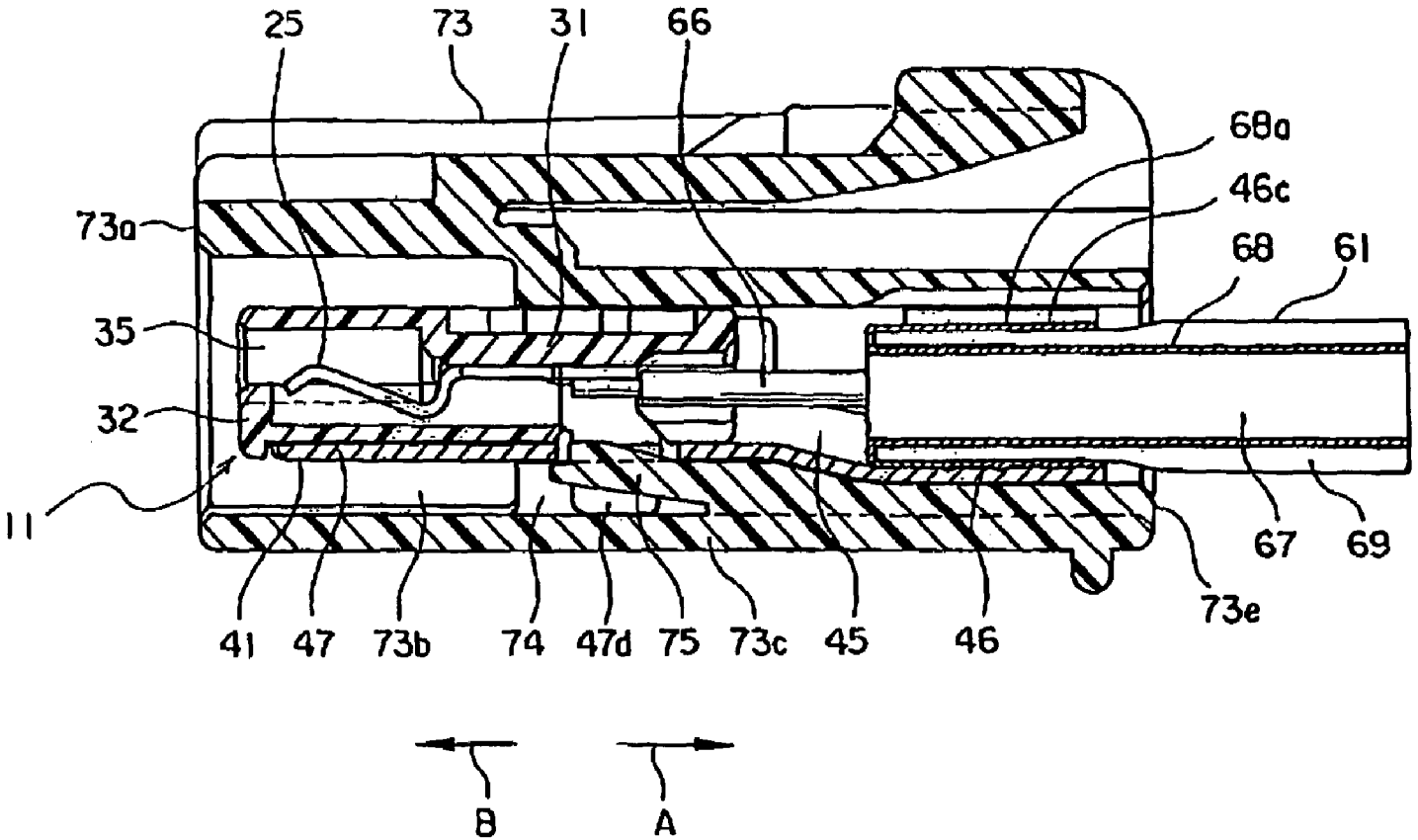
FIG. 5 is a sectional view of a connector according to a second embodiment of this invention.

Referring to FIG. 5, a connector according to a second embodiment of this invention will be described. Similar parts are designated by like reference numerals and description thereof will be omitted.

The connector illustrated in the figure comprises the connector 11 shown in FIGS. 1 to 4 and an additional housing 73 coupled to the connector 11. The additional housing 73 is provided with an additional receiving portion 74 for receiving the connector 11. The additional receiving portion 74 has an additional coupling portion 73*b* formed on an additional coupling surface 73*a* on a coupling side, and a lance 75 formed at one end of the additional coupling portion 73*b* in the separating direction A and extending from a bottom portion 73*c* of the additional housing 73 in the coupling direction B in the additional receiving portion 74.

The connector 11 connected to the cable 61 is inserted into the additional receiving portion 74 from a rear surface 73*e* of the additional housing 73 with the coupling surface 32 directed forward. At this time, the connector 11 is moved in the coupling direction B with an outer surface of the base plate portion 47 of the shell 41 pressing the lance 75 to bend the lance 75 towards the bottom portion 73*c* of the housing 73.

When the coupling portion 35 is positioned in the additional coupling portion 73*b*, the lance 75 is inserted between the locking tab portions 47*c* and 47*d* of the shell 41 to be engaged with the base plate portion 47. Thus, the connector 11 is prevented from being pulled out from the housing 73 in the separating direction A.

The housing 73 may be formed as a connector holding a contact. In this case also, by forming the additional receiving portion 74, the connector 11 can be held in the housing 73.

Figure 6:
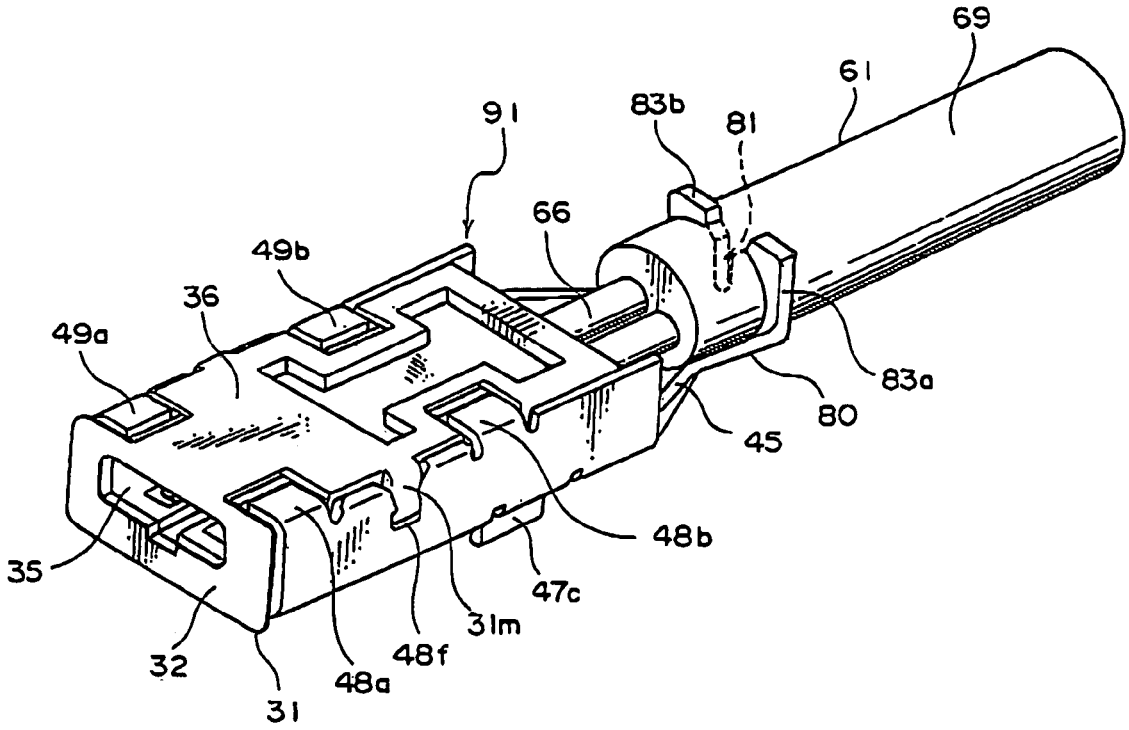
FIG. 6 is a perspective view of a connector according to a third embodiment of this invention.

Referring to FIG. 6, a connector according to a third embodiment of this invention will be described. Similar parts are designated by like reference numerals and description thereof will be omitted.

The connector depicted at 91 in the figure is different from the connector 11 shown in FIGS. 1 to 4 in that the cable holding portion 46 of the shell 41 for connecting the cable 61 is replaced by a cable holding portion 80. Specifically, the cable holding portion 80 connected to the main body 43 via the coupling portions 45 has a generally L shape in a side view and is provided with a slit 81 extending from its end. By forming the slit 81, the cable holding portion 80 has two press-fit tab portions 83*a* and 83*b*. The cable 61, more specifically, the outer cladding portion 69 is press-fitted and held between the press-fit tab portions 83*a* and 83*b* of the slit 81. So that, the cable holding portion 80 is connected to the outer conductor portion 68 with penetrating the outer cladding portion 69.

Figure 7:
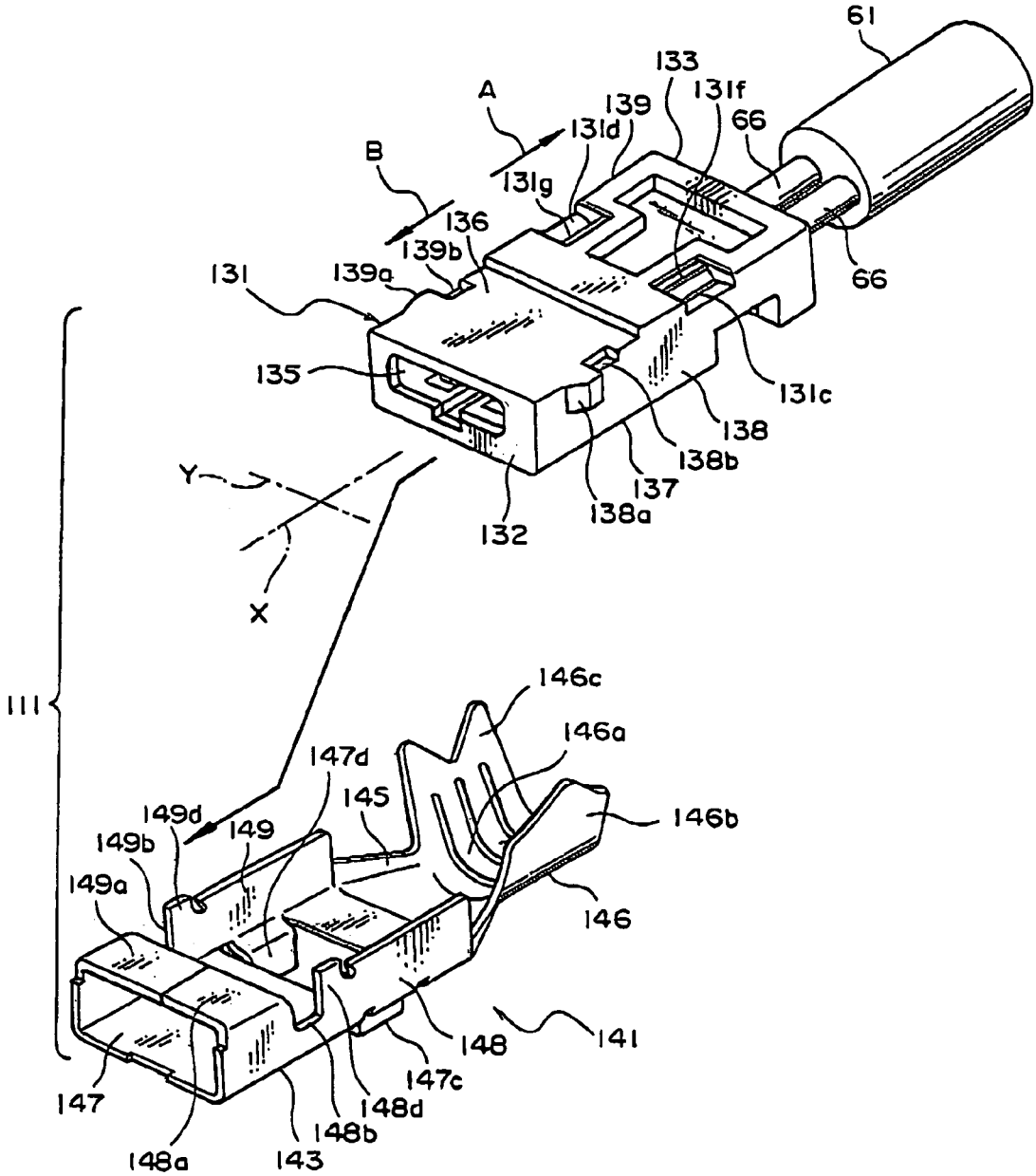
FIG. 7 is an exploded perspective view of a connector according to a fourth embodiment of this invention.

Referring to FIG. 7, a connector according to a fourth embodiment of this invention will be described. Similar parts are designated by like reference numerals and description thereof will be omitted.

The connector depicted at 111 in the figure comprises a conductive contact 21, an insulating housing 131 holding the contact 21, and a conductive shell 141 held on an outer peripheral surface of the housing 131. The housing 131 has a coupling surface 132 as a forward surface in the coupling direction B, a rear surface 133 as a forward surface in the separating direction A, and a receiving portion (similar to the receiving portion 34 in FIG. 2) formed between the coupling surface 132 and the rear surface 133 in the housing 131 to receive the contact 21.

The coupling surface 132 is faced to the mating connector 51 (FIG. 1) in the coupling direction B and the separating direction A when the connector 111 and the mating connector 51 are coupled to and separated from each other. The coupling surface 132 is provided with a coupling portion 135. The coupling portion 135 serves to receive the mating coupling portion 52 of the mating connector 51 to bring the mating contact 53 into contact with a contacting portion (see the contacting portion 25 in FIG. 2) of the contact 21. The rear surface 133 is a part through which the cable 61 is introduced into the housing 131.

An outer peripheral surface of the housing 131 has a first surface 136 parallel to the virtual plane containing the first axis X and the second axis Y, a second surface 137 faced to the first surface 136 in parallel thereto, and a third surface 138 connecting one sides of the first and the second surfaces 136 and 137 which are perpendicular to the second axis Y, and a fourth surface 139 connecting the other sides of the first and the second surfaces 136 and 137 which are perpendicular to the second axis Y.

The third surface 138 is provided with a first protrusion 138*a* formed in the vicinity of the coupling surface 132 and the first surface 136. The fourth surface 139 is provided with a second protrusion 139*a* formed in the vicinity of the coupling surface 132 and the first surface 136.

On a rear side of the first protrusion 138*a* in the coupling direction B, a first engaging portion 138*b* is formed across the first and the third surfaces 136 and 138. On a rear side of the second protrusion 139*a* in the coupling direction B, a second engaging portion 139*b* is formed across the first and the fourth surfaces 136 and 139.

The first engaging portion 138*b* has a recessed shape slightly depressed from the first and the third surfaces 136 and 138. The second engaging portion 139*b* has a recessed shape slightly depressed from the first and the fourth surfaces 136 and 139.

At a portion where the first and the third surfaces 136 and 138 intersect each other, a third engaging portion 131*c* is formed in the vicinity of the rear surface 133 across the first and the third surfaces 136 and 138. At a portion where the first and the fourth surfaces 136 and 139 intersect each other, a fourth engaging portion 131*d* is formed in the vicinity of the rear surface 133 across the first and the fourth surfaces 136 and 139. The third and the fourth engaging portions 131*c* and 131*d* are faced to each other on the first surface 136 in the direction parallel to the second axis Y. The third engaging portion 131*c* has a recessed shape slightly depressed from the first and the third surfaces 136 and 138. The fourth engaging portion 131*d* has a recessed shape slightly depressed from the first and the fourth surfaces 136 and 139. The first surface 136 is provided with groove-like locked portions 131*f* and 131*g* formed in the vicinity of the third and the fourth engaging portions 131*c* and 131*d*, respectively.

In case where the first through the fourth surfaces 136 to 139 of the housing 131 are seen in the state illustrated in FIG. 7, the first surface 136 is an upper surface of the housing 131. The second surface 137 is a lower surface of the housing 131. The third and the fourth surfaces 138 and 139 are side surfaces of the housing 131. The housing 131 having the first through the fourth surfaces 136 to 139, the coupling surface 132, and the rear surface 133 has an external appearance as a generally rectangular parallelepiped shape.

The shell 141 has a main body 143, a pair of connecting portions 145, and a cable holding portion 146 extending from one end of the main body 143 in the separating direction A via the connecting portions 145 in the separating direction A.

The main body 143 has a flat base plate portion 147 parallel to the virtual plane containing the first axis X and the second axis Y, a first holding plate portion 148 perpendicularly bent from one side of the base plate portion 147 which is parallel to the first axis X, and a second holding plate portion 149 perpendicularly bent from the other side of the base plate portion 147 which is parallel to the first axis X.

The base plate portion 147 is faced to the second surface 137 of the housing 131. The first and the second holding plate portions 148 and 149 are faced to the third and the fourth surfaces 138 and 139 of the housing 131 in one-to-one correspondence.

The first holding plate portion 148 is provided with a first shell engaging portion 148*a* for insertion of an outer peripheral portion of the coupling portion 135 of the housing 131. The second holding plate portion 149 is provided with a second shell engaging portion 149*a* for insertion of the outer peripheral portion of the coupling portion 135 of the housing 131. The first and the second shell engaging portions 148*a* and 149*a* are bent in parallel to the base plate portion 147 and joined together at their ends. Therefore, a part surrounded by the first and the second holding plate portions 148 and 149, the base plate portion 147, and the first and the second shell engaging portions 148*a* and 149*a* has a cylindrical shape.

In the vicinity of the first shell engaging portion 148*a* in the separating direction A, a first shell receiving portion 148*b* as a cutout is formed to be engaged with the first protrusion 138*a* of the housing 131. In the vicinity of the second shell engaging portion 149*a* in the separating direction A, a second shell receiving portion 149*b* as a cutout is formed to be engaged with the second protrusion 139*a* of the housing 131.

A first shell protrusion 148*d* extends from the first holding plate portion 148 to be engaged with the first engaging portion 138*b* of the housing 131. A second shell protrusion 149*d* extends from the second holding plate portion 149 to be engaged with the second engaging portion 139*b* of the housing 131.

The base plate portion 147 is provided with a pair of locking tab portions (locking portions) 147*c* and 147*d* each of which is formed by cutting and bending a part of the base plate portion 147. The locking tab portions 147*c* and 147*d* are bent outward of the base plate portion 147 in a direction substantially perpendicular to the base plate portion 147.

The cable holding portion 146 connected via the connecting portions 145 to the base plate portion 147 of the shell 141, a bottom portion 146*a* of the cable holding portion 146, and a pair of holding tab portions 146*b* and 146*c* extending from the bottom portion 146*a* to face each other are similar in shape to the cable holding portion 46, the bottom portion 46*a*, and the holding tab portions 46*b* and 46*c* described in conjunction with FIG. 4.

The shell 141 is coupled to the housing 131 in the following manner. The holding tab portions 146*b* and 147*c* are perpendicularly bent with respect to the base plate portion 147. In this state, the housing 131 having the contact 21 connected to the cable 61 is placed on the base plate portion 147. Then, the outer peripheral portion of the coupling portion 135 of the housing 131 is inserted between the base plate portion 147 and the first and the second shell engaging portions 148*a* and 149*a*. At this time, the first and the second protrusions 138*a* and 139*a* of the housing 131 are engaged with the first and the second shell receiving portions 148*b* and 149*b* of the shell 141. The first and the second shell protrusions 148*d* and 149*d* are bent and engaged with the first and the second engaging portions 138*b* and 139*b* of the housing 131.

The holding tab portions 146*b* and 146*c* are bent towards the end portion 68*a* of the outer conductor 68 of the cable 161 to be press contacted therewith. Further, in case where a plurality of connectors 111 are stacked and integrally used, the locking tab portions 147*c* and 147*d* of the shell 141 of one connector 111 are fitted to the locked portions 131*f* and 131*g* of another connector 111. Then, the locking tab portions 147*c* and 147*d* are engaged with the locked portions 131*f* and 131*g*.

Each of the above-mentioned connectors 11, 91, and 111 may be used for connecting a cable such as a wire harness to an electric apparatus of, for example, an automobile or may be used as a shield connector for relay connection of a shield cable to an antenna.

In each of the connectors 11, 91, and 111, the number of components and the number of assembling steps can be reduced. Further, by simultaneously carrying out the bending operation of the protrusions for fixing the housing to the main body and the fixing operation of the cable, the number of steps for harness work can be reduced. Before the housing is assembled into the main body, the contact received in the housing can be connected to the cable in a stage without any obstacle. Thus, workability is excellent and the quality can be improved.

Although this invention has thus far been described in conjunction with the preferred embodiments thereof, it will readily be possible for those skilled in the art to put this invention into practice in various other manners without departing the scope of the appended claims.

What is claimed is:

1. A connector comprising:

a conductive contact to be connected to a cable;

a housing which holds the contact and which has a first surface that includes an engaging portion; and a conductive shell coupled to the housing, wherein the conductive shell comprises:

a main body which is adapted to cover three surfaces of the housing, so as not to cover the first surface, and which has a protrusion that engages with the engaging portion; and a cable holding portion, which is integral with the main body, for fixing the cable;

wherein the housing has a second surface opposite to the first surface; and wherein the main body includes a locking portion extending away from the second surface, the housing has a locked portion on the first surface, and the locked portion has a shape adapted to receive the locking portion of another connector.

2. The connector according to claim 1, wherein the engaging portion comprises a recessed shape depressed from the first surface, and the protrusion is placed in the engaging portion.

3. The connector according to claim 1, wherein the locked portion comprises a groove adjacent to the engaging portion.

4. The connector according to claim 1, wherein the housing includes an additional engaging portion, and the main body includes an engaged portion that engages with the additional engaging portion.

5. The connector according to claim 4, wherein the additional engaging portion is provided on the first surface.

6. The connector according to claim 4, wherein the housing has another surface adjacent to the first surface, and the additional engaging portion is provided on said another surface.

7. The connector according to claim 1, wherein the cable holding portion comprises a pair of holding tab portions which are rounded and brought into press contact with the cable to hold the cable.

8. The connector according to claim 1, wherein the cable holding portion comprises a slit dividing the cable holding portion into two press-fit tab portions, and the cable is press-fitted in the slit and held between the press-fit tab portions.

9. A connector comprising:

a conductive contact to be connected to a cable;

a housing which holds the contact and which has a first surface that includes an engaging portion; and a conductive shell coupled to the housing, wherein the conductive shell comprises: (i) a main body which is adapted to cover three surfaces of the housing, so as not to cover the first surface, and which has a protrusion that engages with the engaging portion, and (ii) a cable holding portion, which is integral with the main body, for fixing the cable;

an insulator into which an assembly of the housing and the conductive shell is inserted in a coupling direction along which the connector is coupled to a mating connector;

wherein the insulator comprises a lance engaged with the conductive shell to inhibit movement of the assembly with respect to the insulator in a separating direction opposite to the coupling direction;

wherein the housing has a second surface opposite to the first surface;

wherein the main body includes a pair of locking portions extending away from the second surface for locking with another connector, and the locking portions are spaced apart from each other in a direction perpendicular to the coupling direction; and wherein the lance is inserted between the locking portions.

* * * * *